US006991046B2

(12) United States Patent
Fielder et al.

(10) Patent No.: US 6,991,046 B2
(45) Date of Patent: Jan. 31, 2006

(54) EXPANDABLE ECCENTRIC REAMER AND METHOD OF USE IN DRILLING

(75) Inventors: Coy M. Fielder, Cypress, TX (US); Gary D. Wells, Kingwood, TX (US); Rogerio H. Silva, Spring, TX (US); William C. Herben, Magnolia, TX (US)

(73) Assignee: ReedHycalog, L.P., Houston, TX (US)

( * ) Notice: Subject to any disclaimer, the term of this patent is extended or adjusted under 35 U.S.C. 154(b) by 100 days.

(21) Appl. No.: 10/701,232

(22) Filed: Nov. 3, 2003

(65) Prior Publication Data

US 2005/0092526 A1 May 5, 2005

(51) Int. Cl.
*E21B 7/28* (2006.01)

(52) U.S. Cl. ..... 175/57; 175/267

(58) Field of Classification Search ..... 175/57, 175/267, 406

See application file for complete search history.

(56) References Cited

U.S. PATENT DOCUMENTS

| | | | | |
|---|---|---|---|---|
| 3,224,507 A | | 12/1965 | Cordary et al. | |
| 3,365,010 A | | 1/1968 | Howell et al. | |
| 3,425,500 A | | 2/1969 | Fuchs | |
| 3,433,313 A | | 3/1969 | Brown | |
| 3,556,233 A | * | 1/1971 | Gilreath et al. | 175/267 |
| 4,055,226 A | | 10/1977 | Weber | |
| 4,431,065 A | | 2/1984 | Andrews | |
| 6,227,312 B1 | | 5/2001 | Eppink et al. | |
| 6,378,632 B1 | | 4/2002 | Dewey et al. | |
| 6,494,272 B1 | * | 12/2002 | Eppink et al. | 175/57 |
| 2003/0079913 A1 | * | 5/2003 | Eppink et al. | 175/61 |
| 2004/0065479 A1 | * | 4/2004 | Fanuel et al. | 175/267 |
| 2004/0206549 A1 | * | 10/2004 | Dewey et al. | 175/57 |
| 2004/0222022 A1 | * | 11/2004 | Nevlud et al. | 175/57 |

FOREIGN PATENT DOCUMENTS

EP 001398455 A2 * 3/2004

* cited by examiner

*Primary Examiner*—William Neuder
(74) *Attorney, Agent, or Firm*—Jeffery E. Daly

(57) ABSTRACT

An expandable eccentric reamer for placement in a drill string up-hole of a conventional drill bit. The reamer blade is actuated by drilling fluid pressure to radially extend to a drill out diameter greater than a pass-through diameter. The reamer body is shaped to have an eccentric outer surface configuration to accommodate the reamer blade therein. The reamer blade acts as a piston arm in response to drilling fluid pressure and moves along a shaft anchored in a hump region that forms an eccentricity in the outer surface configuration of the body. The reamer blade has an outer edge configuration that positions the cutters thereon to prevent them from engaging a casing of a well borehole upon deployment.

24 Claims, 9 Drawing Sheets

EXPANDABLE ECCENTRIC REAMER AND METHOD OF USE IN DRILLING

BACKGROUND OF THE INVENTION

1. Field of the Invention

The present invention generally relates to downhole tools useful for drilling oil, gas and water wells. More specifically, the present invention relates to a downhole drilling tool used to pass through a smaller hole and drill a larger hole.

2. Description of the Prior Art

Various methods have been devised for passing a drilling assembly through an existing cased borehole and permitting the drilling assembly to drill a new borehole that is of a larger diameter than the inside diameter of the existing upper cased borehole. One such method uses an under-reamer, which is collapsed to pass through the smaller diameter existing, cased borehole and then expanded to ream the new, larger diameter borehole for the installation of larger diameter casing. Another method is the use of a winged reamer disposed above a conventional bit.

Under-reamers usually have hinged arms with attached cutters. The tool typically has pocket recesses formed in the body where the arms are retracted when the tool is in a closed state. Most of the prior art under-reamers utilize swing out cutter arms that are pivoted at an end opposite the cutting end of the reamer and are actuated by mechanical or hydraulic forces acting on the arms to extend or retract them. Some examples of these types of under-reamers are shown in U.S. Pat. Nos. 3,224,507; 3,425,500; and 4,055,226.

An example of a hydraulically expandable, concentric reaming tool is the RHINO reamer of Smith International, Inc. The tool includes three cutter blocks that are equally spaced around the tool circumference and carrying PDC cutting elements. The cutter blocks are extended from a collapsed position by hydraulic actuation. The cutter blocks include a stabilizer gauge pad and a formation cutting structure. A lock-up system restricts fluid from actuating the cutter blocks during shoe track drill out.

Another example of a hydraulically expandable, concentric reaming tool is the REAMASTER reamer of Smith International, Inc. This tool is illustrated in U.S. Pat. No. 4,431,065, which describes it as having a tubular body for connection to a drill string and a cutting arm received within a recess in the tubular body. The cutting arm is moved between a retracted position approximately aligned with the axis of the tubular body and a deployed position extending laterally outwardly of the body by a hydraulic plunger that actuates the cutting arms from a fully retracted to a fully deployed position.

An example of a mechanically actuated expandable drill bit that does not use pivoting cutter arms to ream a borehole is shown in U.S. Pat. No. 3,365,010. Blades with cutters ride in opposed, axially oriented channels angled with respect to the axis of the tool. When the blades impact the bottom of the borehole, shear pins retaining the blades are broken allowing the blades to move up the channels thereby expanding out against the borehole wall for subsequent borehole enlargement. A large pin for each blade retains the expanded blades in a desired position to control the gage of the borehole. When the expandable drill bit is tripped out of the borehole, the blades fall down the angled tracks through frictional and gravitational forces.

The under-reamer shown in U.S. Pat. No. 3,433,313 has a tubular body with a sleeve movably positioned therein and adapted to move responsive to the pressure of drilling fluid. Movement of the sleeve deploys the cutters to their cutting position. The sleeve is moved in the opposite direction with a wireline tool to retract the cutters from their cutting position and also stop the flow of drilling fluid to allow retraction of the cutters.

An expandable under-reamer is disclosed in U.S. Pat. No. 6,378,632 having an under-reamer body forming at least a pair of opposed downwardly and inwardly angled slots. Fluid is circulated through the under-reamer body. At least a pair of cutter assemblies housed within the under-reamer body is adapted to engage in the opposed angled slots formed by the under-reamer body. Each cutter assembly consists of a cutter support body having a track at a first end, a piston at a second end, and cutters formed in between the ends. The piston is slides within a sleeve formed in the under-reamer body and extending parallel with the angled slots formed in the under-reamer body. The sleeve is in fluid communication with a control port formed in the under-reamer body. Fluid under pressure, when admitted to the piston sleeve below the piston, drives the cutter assembly upwardly and outwardly along the angled slots to commence an under-reaming operation. A spring means in the under-reamer body retracts the cutter assemblies when fluid is shut off at the control port. The hydraulically operated under-reamer opens a borehole below a restriction that is larger than the restriction itself. The under-reamer has a cutter system with a pair of cutters that engage the formation by traversing upward and outward along a track that is angled with respect to an axis of the under-reamer body. The cutters are forced to the extended position by a piston built into each cutter support. Pressure acting on the piston comes from the pressure differential between the annulus and the drill string during circulation of the drilling fluid.

A related type of tool available from Halliburton Security DBS is the Near Bit Reamer. The tool is designed to open the borehole to a larger diameter than the pilot bit. Once the tool is below the casing shoe, the reamer blades are hydraulically actuated. The Near Bit Reamer is adapted for use just above the drill bit or above a rotary steerable system. Also available from Halliburton Security DBS is the XL2 Series under-reamer. This tool can be provided as an expandable stabilizer and is run in conjunction with an under-reamer for better stability. The arms are opened hydraulically and closed mechanically by a return spring.

Another tool described as an eccentric adjustable diameter blade stabilizer is shown in U.S. Pat. No. 6,227,312. The eccentric stabilizer is adapted for mounting on a bi-center bit having an eccentric reamer section and a pilot bit. A pair of adjustable stabilizer blades is recessed within openings in a housing. The blades are radially extended by a camming action produced upon axial movement. An extender piston causes the blades to radially extend and a return spring causes the blades to retract.

Bi-center bits have been used as an alternative to under-reamers as a downhole drilling tool. The bi-center bit is a combination reamer and pilot bit. The reamer section is disposed up-hole of the pilot bit. The pilot bit drills a pilot borehole and the eccentric reamer section follows the pilot bit reaming the pilot borehole to the desired diameter for the new borehole. A desirable aspect to the bi-center bit is its ability to pass through a small hole and then drill a hole of a larger diameter. The drill out diameter of a bi-center bit is limited by the pass-through diameter and the maximum tool diameter. The maximum drill out diameter is related to these parameters by the equation $D_{drill\ out}=2*D_{pass\text{-}through}-D_{max\ tool}$. It would be desirable to have a downhole tool capable of drilling to a diameter significantly larger than the pass-through diameter.

SUMMARY OF THE INVENTION

The present invention provides a downhole tool to be disposed in a drill string up-hole of a conventional drill bit. In one embodiment, the downhole tool provides a drilling tool for drill out diameter for the borehole that is significantly larger than a pass-through diameter. In another embodiment, the downhole tool provides a stabilizer tool.

An elongated body defining a longitudinal axis has first and second ends for attachment to a drill string. An internal space of the body is supplied with a drilling fluid under pressure. A reamer blade having a plurality of cutter elements is housed within the elongated body and actuated by the pressure of the drilling fluid to radially extend for deployment to a drill out diameter larger than a pass-through diameter. The reamer blade has a curved outer edge configuration that positions the cutters thereon to prevent them from engaging a casing of a well borehole upon deployment. The body has an eccentrically shaped outer surface configuration to house the reamer blade. The downhole tool can be characterized as an "expandable eccentric reamer" and is distinguishable from "concentric" reamers, which have a body with a tubular shaped outer surface configuration.

In a method of drilling a well borehole, a drill bit is affixed to a drill string and an expandable eccentric reamer is provided in the drill string up-hole from the drill bit. The drill bit can be a bi-center bit having reamer blades. If so, an area of eccentricity on the eccentric reamer is aligned with the reamer blades of the bi-center bit. A second expanded eccentric reamer can be provided in the drill string up-hole from the first eccentric reamer. The first eccentric reamer deploys its cutters to a first drill out diameter and the second eccentric reamer deploys its cutters to a second drill out diameter. The first and second drill out diameters may be the same or different wherein the second drill out diameter is larger than the first drill out diameter. An area of eccentricity on the first expandable eccentric reamer is evenly spaced radially from an area of eccentricity on the second expandable eccentric reamer.

DETAILED DESCRIPTION OF THE PREFERRED EMBODIMENT

Figure 1:
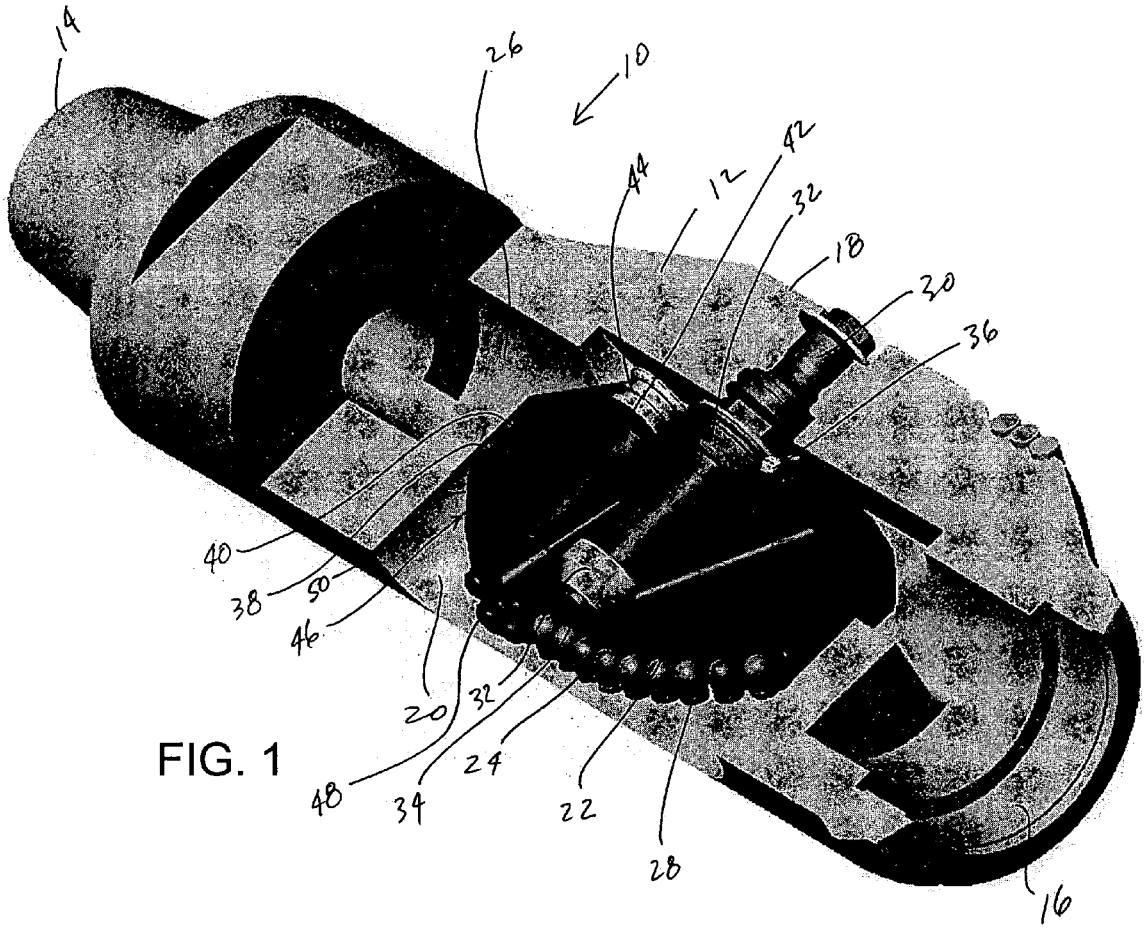
FIG. 1 is a cutaway illustration of the expandable eccentric reamer with the blade in the retracted position.
Figure 2:
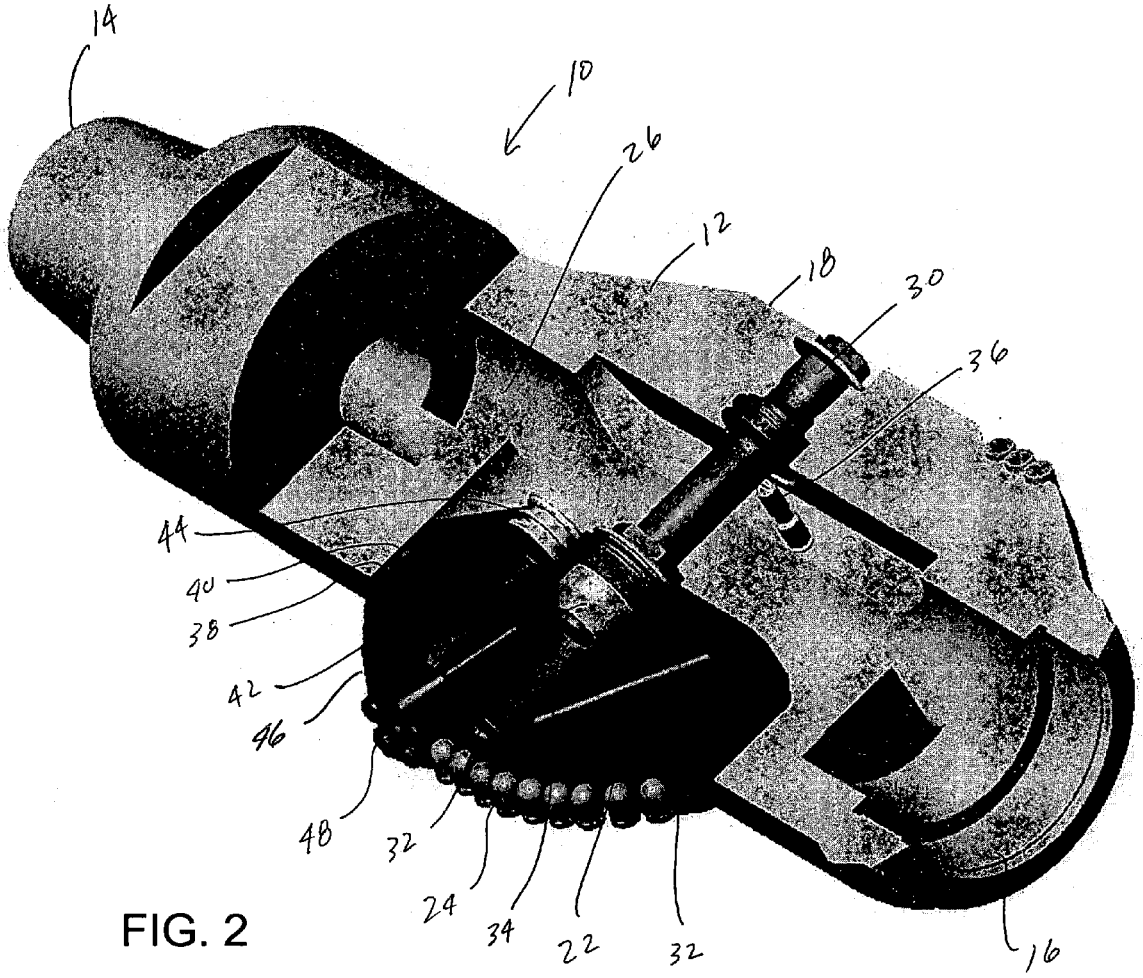
FIG. 2 is a cutaway illustration of the expandable eccentric reamer with the blade in the extended position.

In FIGS. 1 and 2, a down-hole tool 10 in accordance with the present invention is shown. Tool 10 is generally of a type known as a "reamer." Tool 10 has a body 12 adapted for coupling along the length of a drill string (not shown) by attachment at the proximal end 14 and the distal end 16. Ends 14 and 16 preferably have threaded couplings to mate with the threaded ends of drill pipe. Tool 10 would be placed in the drill string up-hole of conventional drill bit. The elongated body 12 defines a longitudinal axis and in relation thereto has an eccentric outer surface configuration due to a hump area 18 between ends 14 and 16. Preferably, the eccentric shape of body 12 closely matches the shape of conventional bi-center bits and allows the tool 10 to be aligned with and run behind a conventional bi-center bit. An example of such a bi-center bit is that shown in U.S. Pat. No. 5,678,644, which is hereby incorporated by reference in its entirety. In use with a bi-center bit, the hump area 18 is aligned with the reamer blades of the bi-center bit. Tool 10 can also be used with a standard drill bit and without necessity of alignment of the eccentric shape with the drill bit. Also, the spacing between the tool 10 and the drill bit may vary. The tool 10 may, for example, be "stacked" directly above the drill bit by providing suitable mating threaded connections on the drill bit body and the tool 10 body.

Housed within a cavity 20 of body 12 is a piston, which forms a reamer blade 22. The cavity 20 is in the form of an elongated, radial slot. The length of the slot extends parallel to the longitudinal axis of tool 10 and the depth of the slot extends radially of the longitudinal axis of the tool 10. As seen in FIG. 1, blade 22 carries a plurality of cutter elements 24 of conventional design, for example, polycrystalline diamond compact ("PDC") cutters. The blade 22 is radially extended to the position shown in FIG. 2 under the influence of the fluid pressure of drilling fluid or mud that is pumped into the interior space 26 within body 12. It is in this manner that the backside surface of blade 22 acts as a piston. As seen in FIG. 1, blade 22 travels axially along retention shaft 28. An end 30 of shaft 28 is anchored in the hump area 18 of body 12. Blade 22 is coupled to shaft 28 by a collar that slides along shaft 28 until the stop limit member 32 at the opposite end 34 of shaft 28 is reached as shown in FIG. 2. The length of travel permitted by shaft 28 and limit stop member 32 determine the drill out diameter of tool 10.

The blade 22 is extended by exposure to the drilling fluid pressure in the internal space 26. In order to assure that blade 22 is maintained in the retracted position until time of deployment, a retaining shear pin 36 is provided. Until drilling fluid pressure builds to a sufficient level to break pin 36, blade 22 remains within body 12. The force necessary to break pin 36 can, of course, be varied as desired. To insure proper deployment and use of blade 22, the internal space 26 must be sealed from the external fluid pressure of the well bore. Two O-rings 38 and 40 are provided to isolate the internal space 26 from the external fluid pressure of the well bore.

To maintain proper deployment of blade 22, a reservoir 42 of grease is provided within the body of blade 22. The reservoir is closed-off by cap 44. The cap is in direct contact with the drilling fluid pressure, which pushes down on cap 44 and forces grease from the reservoir 42 into the region between the O-rings 38 and 40. The grease provides lubrication of the steel surfaces to permit easier movement of the piston arm. Further, the region between the O-rings is pressurized to assist in maintaining the seal between the internal space 26 and the external space of the well bore.

Retraction of blade 22 can be accomplished by reducing fluid pressure within internal space 26 and pulling the tool 10 into the casing. To this end, the edge 46 of blade 22 has a tapered portion 50. The angle of the tapered edge provides a cam action that causes the blade to be retracted into slot 20.

Figure 3B:
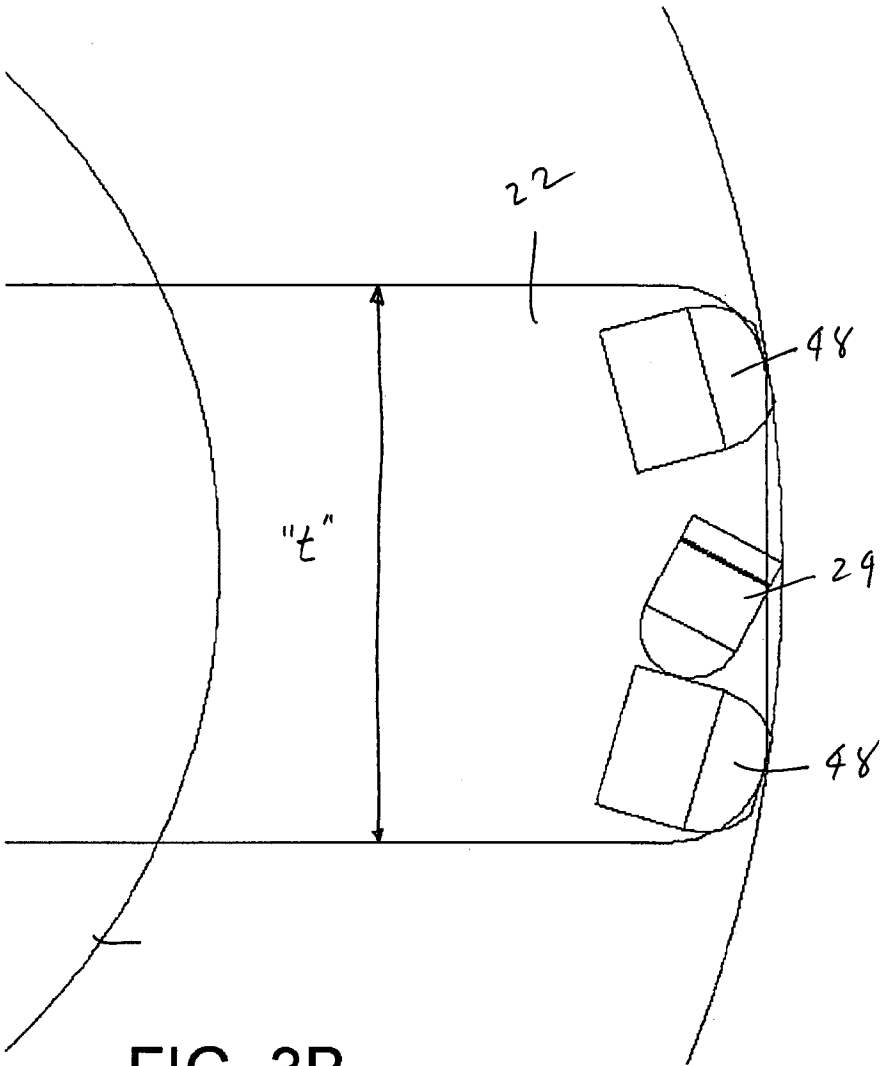
FIGS. 3A and 3B illustrate the manner in which damage to a casing is avoided in the event of premature deployment of the blade in the extended position.
Figure 3A:
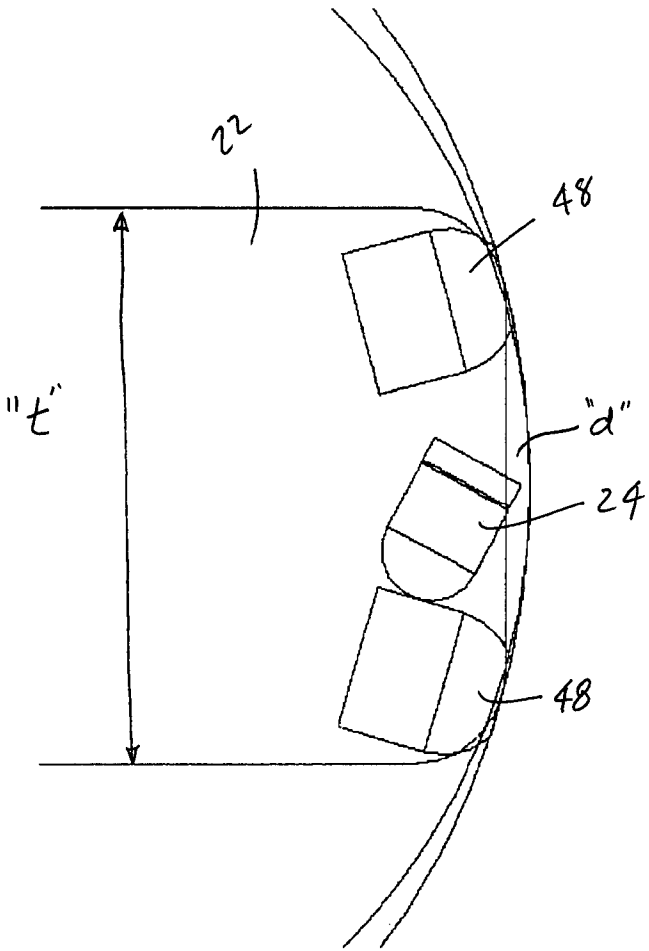

Referring to FIGS. 3A and 3B, there is illustrated the manner in which damage to a casing is avoided in the event of premature deployment of the blade 22 in the extended position. Shown in these views is the blade 22 in the non-retracted position. Each view is from above and looking down upon a cross section of the tool 10. In FIG. 3A, blade 22 is shown prematurely deployed while still in the casing. The cutting element 24 and non-cutting elements 48 are shown mounted on blade 22. As seen, while the tool is in the casing, there is a gap distance "d" between the radius of curvature of the pass through diameter and the cutting element 24. Thus, while the non-cutting elements 48 can contact the casing, the cutting element 24 cannot. When the blade 22 is fully deployed outside the casing, the radius of curvature of the larger drill out diameter provides for the cutting element 24 and the non-cutting elements 48 to be in contact with the formation. As seen the thickness "t" of the blade 22 and the radius of curvature "r" of the outer end surface of the blade 22 are selected to match the intended drill out diameter. Because the casing diameter is smaller than the intended drill out diameter, the blade has contact points at its edges where non-cutting elements 48 are located. The non-cutting elements 48 contact the casing and prevent cutting element 24 from contacting the casing.

Figure 4:
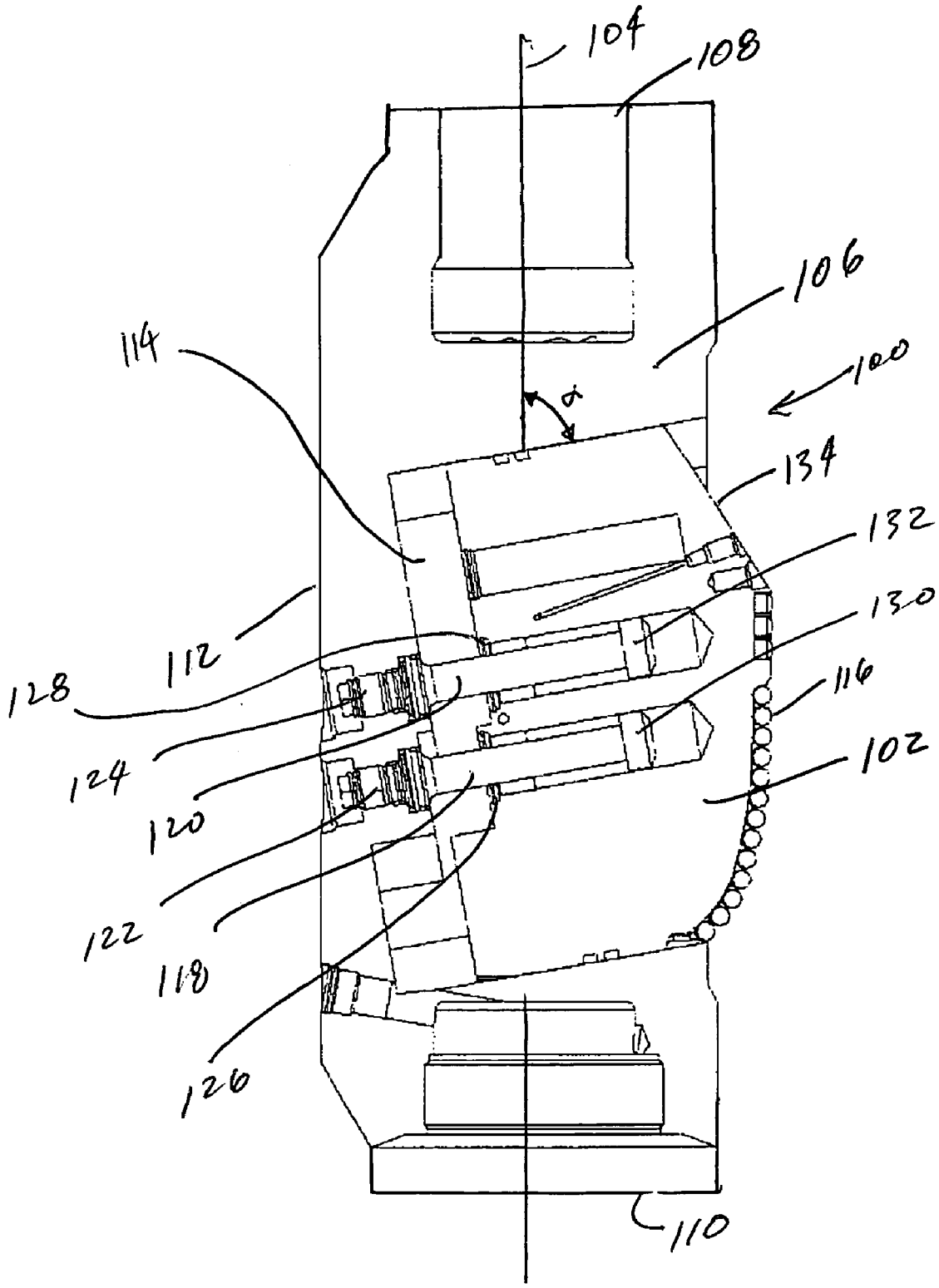
FIG. 4 shows a cross-section view of an alternate embodiment wherein the blade is angled with respect to the longitudinal axis of the tool body.

In FIG. 4, an alternative embodiment to tool 10 is shown. In this embodiment, tool 100 has a blade 102 that is angled or canted with respect to longitudinal axis 104 at an angle "α". The angle "α" is preferably about 10°. Tool 100 has a body 106 that is adapted for coupling along the length of a drill string by attachment at the proximal end 108 and the distal end 110. Ends 108 and 110 preferably have threaded couplings to mate with the threaded ends of drill pipe. Tool 100 would be placed in the drill string up-hole of conventional drill bit. The elongated body 106 defines the longitudinal axis 104 and in relation thereto has an eccentric outer surface configuration due to a hump area 112 between ends 108 and 110. Preferably, the eccentric shape of body 106 closely matches the shape of conventional bi-center bits and allows the tool 100 to be aligned with and run behind a conventional bi-center bit.

Blade 102 is housed within a cavity 114 formed in body 106. The cavity 114 is in the form of an elongated, radial slot. The length of the slot extends parallel to the longitudinal axis of tool 100 and the depth of the slot extends radially of the longitudinal axis of the tool 100. As seen in FIG. 4, blade 102 carries a plurality of cutter elements 116 of conventional design, for example, polycrystalline diamond compact ("PDC") cutters. The blade 102 is radially extended from cavity 114 as shown in FIG. 4 under the influence of the fluid pressure of drilling fluid or mud that is pumped into the interior space behind blade 102. It is in this manner that the backside surface of blade 102 acts as a piston. As seen in FIG. 4, blade 102 travels axially along a pair of retention shafts 118 and 120. An end 122 of shaft 118 is anchored in the hump area 112 of body 106; and an end 124 of shaft 120 is anchored in the hump area 112. Blade 102 is coupled to shafts 118 and 120 by collars 126 and 128 that slide along shafts 118 and 120, respectively, until the stop limit members 130 and 132 at the opposite ends of shafts 118 and 120 are reached. The length of travel permitted by shafts 118 and 120 together with limit stop members 130 and 132 determine the drill out diameter of tool 100. Retraction of blade 102 can be accomplished by reducing fluid pressure within the internal space of body 106 and pulling the tool 100 into the casing. To this end, the edge 134 of blade 102 is tapered. The angle of the tapered edge provides a cam action that causes the blade to be retracted into the slot.

In a method of drilling a well borehole, tool 10 or tool 100 can be provided up-hole of a drill bit. In the case of a bi-center bit, its reamer blades can produce a large cutting force. The blade of the tool extends from the opposite side and serves to offset the bi-center reamer blades cutting force. The opposing forces assist in stabilizing the bi-center reamer and makes for a more accurate well borehole size. In order to further increase hole size and stability, in a method of drilling, a pair of tools 10 or 100 can be coupled into the drill string up-hole from a drill bit. When used behind a bi-center bit, a first of the tools 10 or 100 is aligned with the bi-center bit as described. The second tool 10 or 100 will have the eccentricity of the body extending in the opposite direction. The tools 10 or 100 would drill to the same drill out diameter and serve to act as a two-bladed stabilizer. As an alternative drilling configuration, the stacked tools 10 or 100 could be sized to drill to a different diameter. In that situation, the distal tool nearer the drill bit would have a smaller drill out diameter than the proximal tool, which would extend to the final drill out diameter. If multiple tools are used, preferably a standard drill bit rather than a bi-center bit would be employed. Also, if multiple tools are used, the hump area on each would be evenly spaced radially from one another. That is, if two tools were used, the hump areas on them would be spaced apart 180°. If three tools were used, the hump areas on them would be spaced apart 60°.

Figure 5:
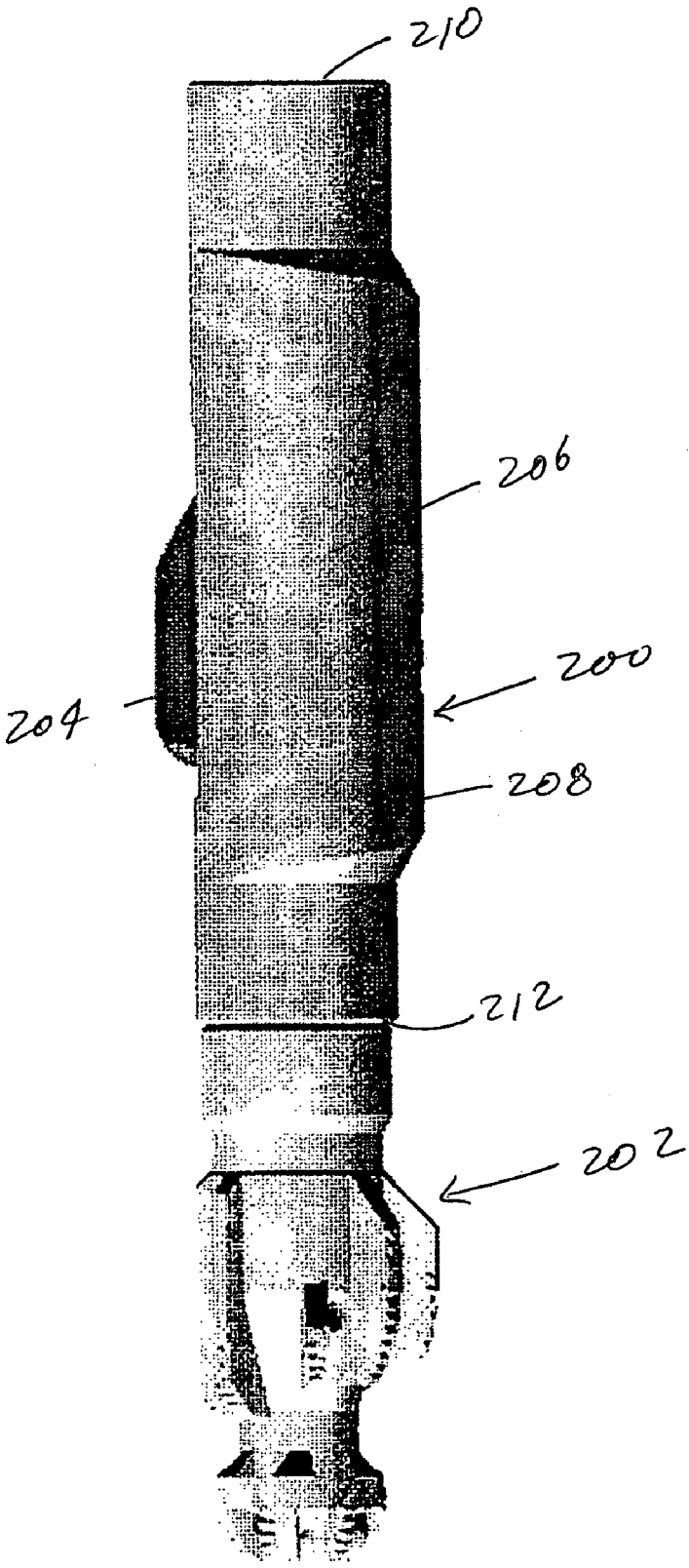
FIG. 5 shows an eccentric stabilizer coupled to a bi-center bit.
Figure 6:
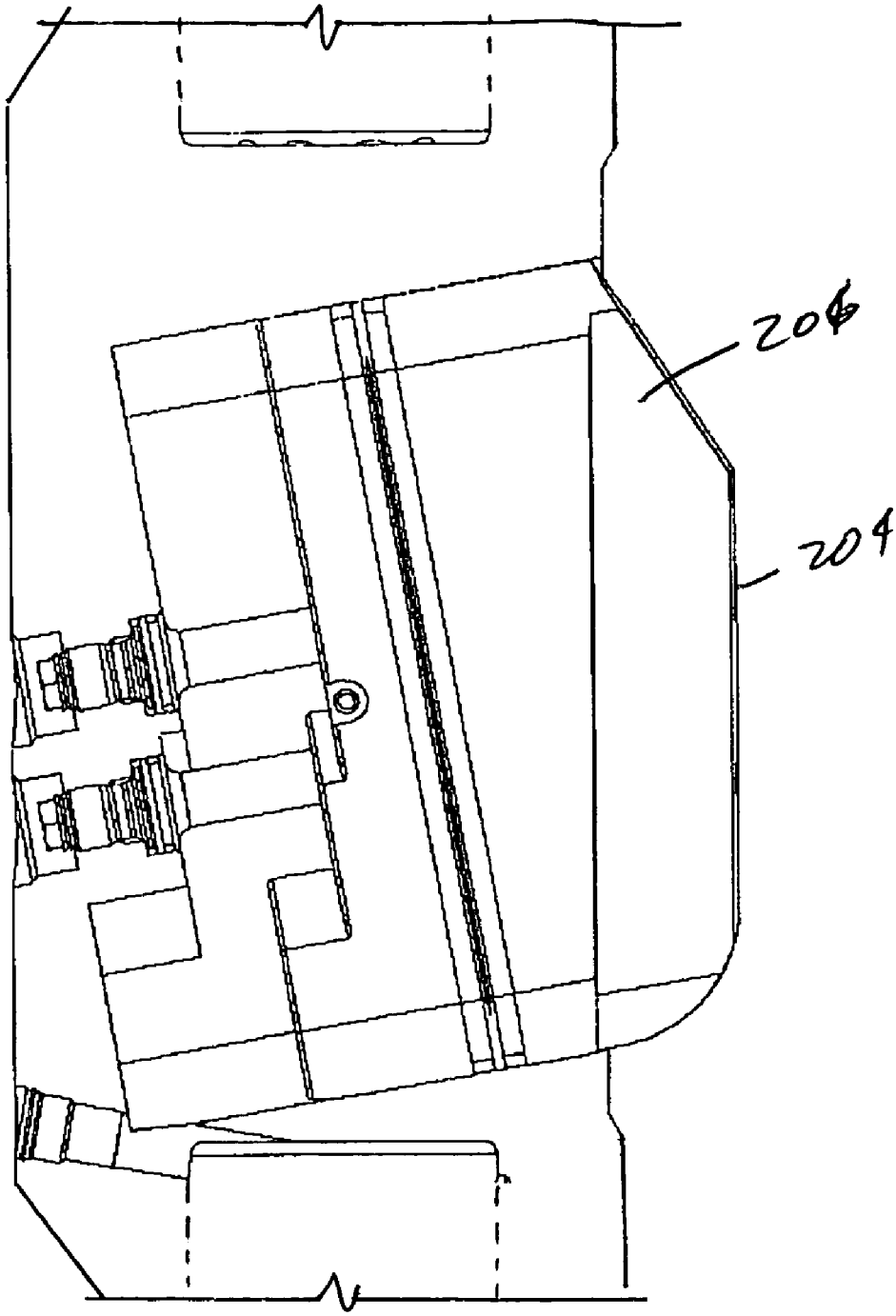
FIG. 6 shows a cross-section view of the eccentric stabilizer in FIG. 5.

In FIG. 5, there is illustrated an eccentric stabilizer 200 coupled to a bi-center bit 202. As shown, a stabilizer pad 204, which is a non-cutting surface, is shown in the extended position. Pad 204 may be a smooth surface comprising carbide blocks with hard-facing to permit it to slide along the formation wall. The body 206 of stabilizer 200 has an eccentric outer configuration provided by a hump area 208. The proximal end 210 is adapted to be connected to a drill string. The bi-center bit is coupled to the distal end 212. FIG. 6 shows a cross-section of stabilizer 200. As seen, the stabilizer 200 is similar to tool 100 of FIG. 4. However, rather than having cutting elements, blade 206 has pad 204.

Figure 7:
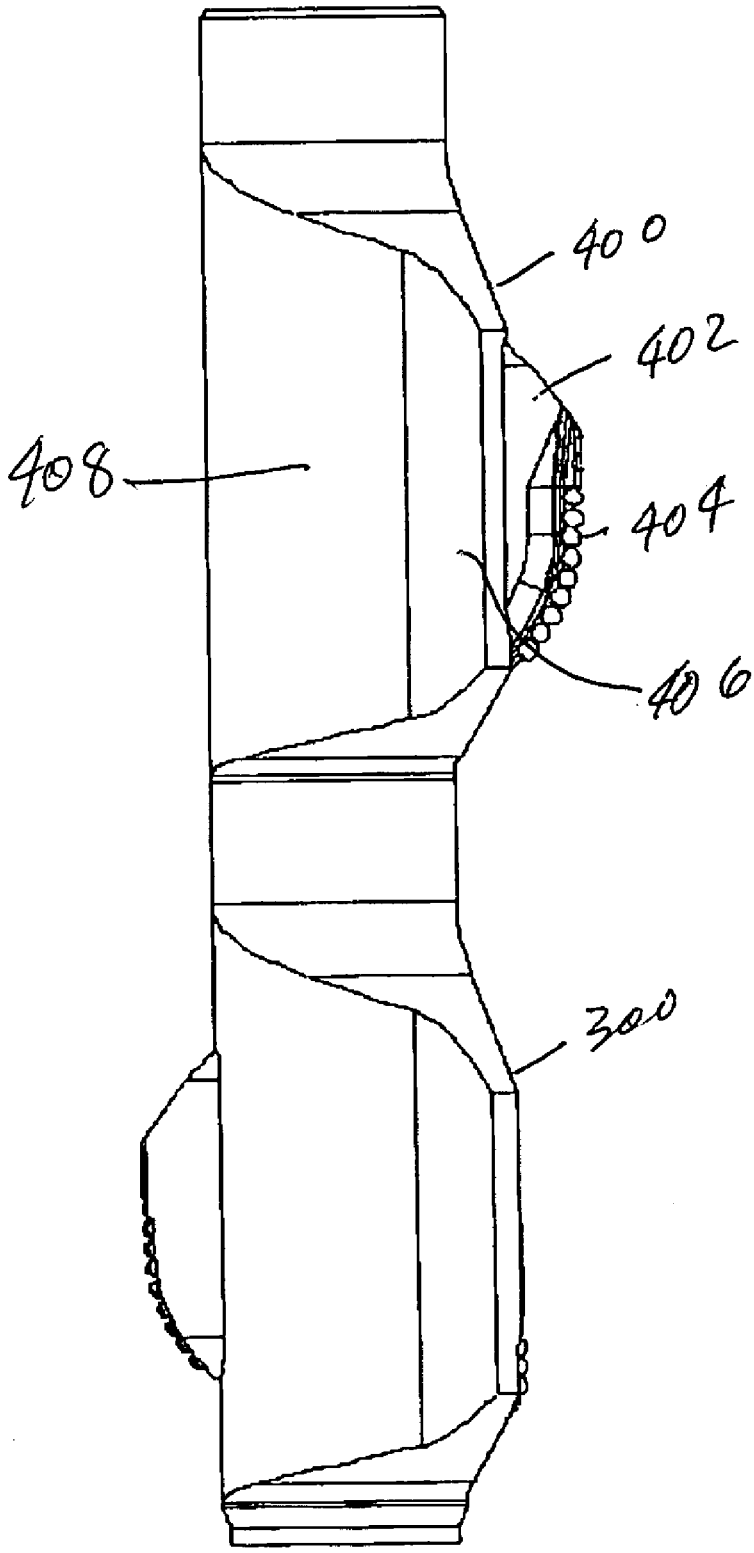
FIG. 7 shows a side view of a stacked arrangement of downhole tools.
Figure 8:
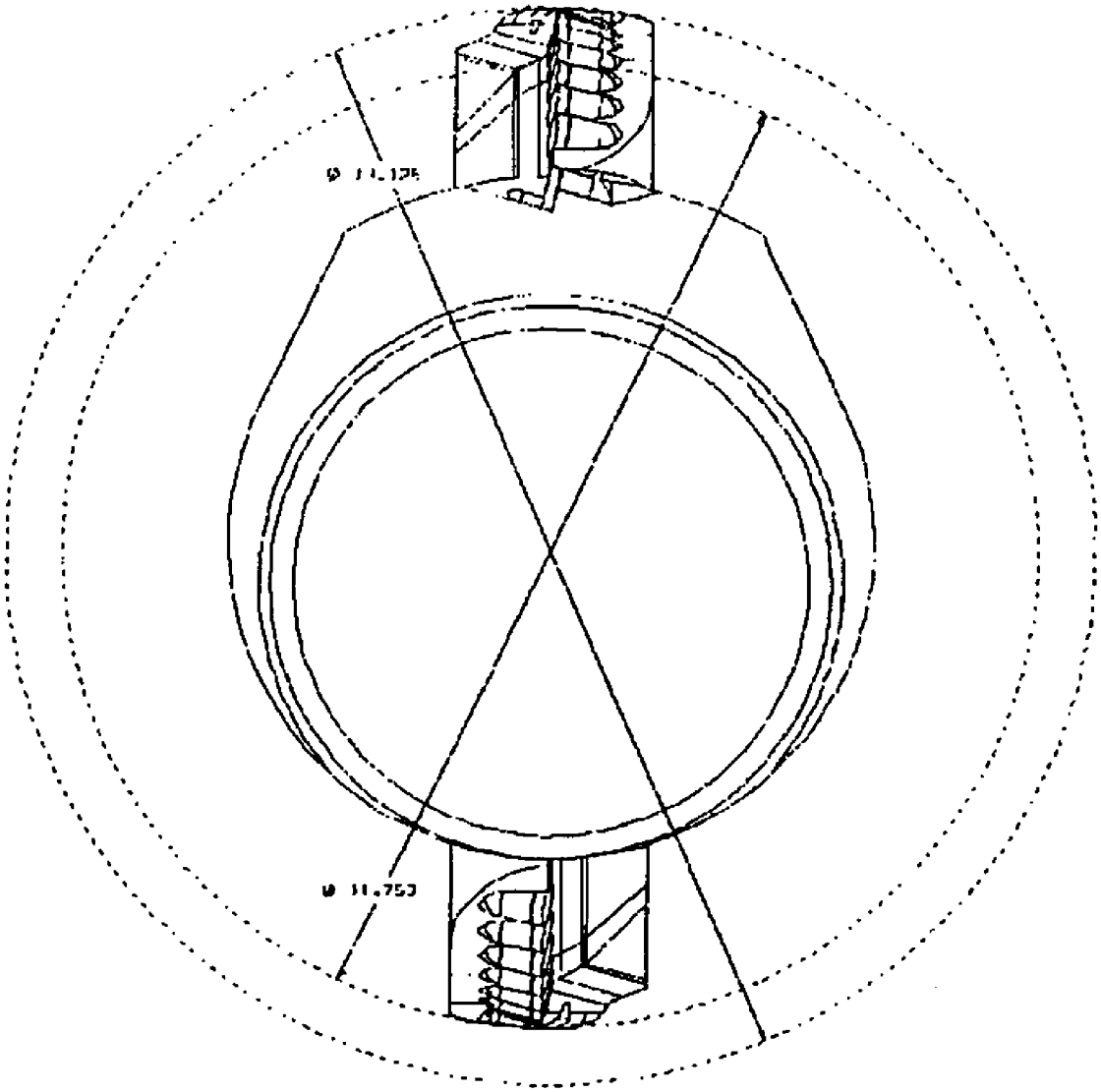
FIG. 8 shows a top view of the stacked arrangement of downhole tools shown in FIG. 7.

FIG. 7 shows a stacked arrangement of downhole tools 300 and 400. Tool 300 is in accordance with either tool 10 (FIGS. 1 and 2) or tool 100 (FIG. 4). Tool 400, however, is of a different configuration. The body of tool 400 has an eccentric-shaped outer surface configuration. But, the blade 402 with cutting elements 404 extends from the hump area 406 of body 408. When two "eccentric" tools are stacked, the humps must be aligned in order for the assembly to be able to trip into the hole. FIG. 8 is a top view of the stacked arrangement of tools 300 and 400 with the blades of the tools in the extended position for drilling.

Figure 9:
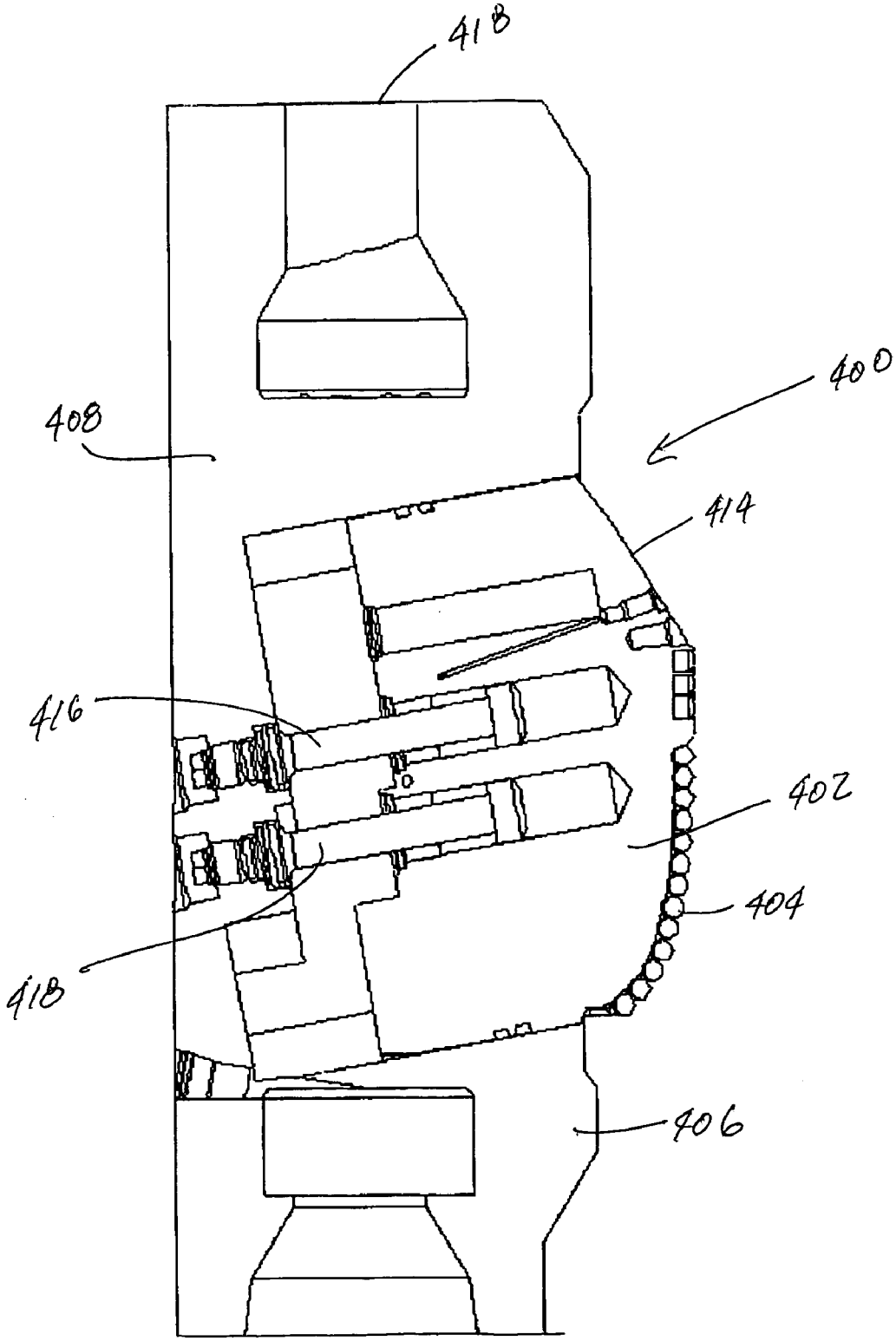
FIG. 9 shows a cross-section view of the upper downhole tool of the stacked arrangement shown in FIG. 7.

FIG. 9 shows tool 400 in cross-section. Tool 400 has a similar internal mechanical construction to tool 100. Tool 400 has blade 402 angled or canted with respect to the longitudinal axis of the tool body. The body 408 is adapted for coupling along the length of a drill string by attachment at the proximal end 410. The distal end 412 is configured for coupling to tool 300 either directly or indirectly through a short section of drill pipe. Blade 402 is moved by hydraulic pressure to extend from hump area 406 of body 408. The beveled surface 414 engages the casing to urge blade 402 into the retracted position when the tool is being retrieved. Shafts 416 and 418 are anchored at one end within body 408. Blade 402 slides along shafts 416 and 418 as it is being extended and retracted.

A stacked arrangement of tools can comprise a combination of a stabilizer in accordance with tool 200 and a reamer tool in accordance with tool 10. Thus, a method of drilling a wellbore may be implemented using a combination of a stabilizer, a reamer tool, and a drill bit. It is to be understood that, as in the stacked combination shown in FIG. 7, when two "eccentric" tools are stacked, the humps must be aligned in order for the assembly to be able to trip into the hole. Thus, the stabilizer and the reamer tool will necessarily have opposing eccentric shaped bodies.

The foregoing disclosure and description of the invention is illustrative and explanatory thereof, and it will appreciated by those skilled in the art, that various modifications and may be made in the illustrated embodiments. While the present invention has been described in connection with presently preferred embodiments, it is to be understood that the illustrated embodiments are not intended to be limiting of the invention to those embodiments. Rather, the scope of the invention contemplates all alternatives, modifications, and equivalents that are included within the scope of the appended claims.

What is claimed is:

1. A downhole tool comprising: an elongated body with first and second ends for attachment to a drill string, the body defining an eccentric outer surface configuration between its ends;

a blade housed within the elongated body and actuated under fluid pressure for deployment to a drill out diameter larger than a pass-through diameter;

a shaft mounted within the elongated body perpendicular to the longitudinal axis of the body, and a collar coupling the blade to the shaft for radially extended movement along the shaft upon actuation.

2. The downhole tool of claim 1, wherein the blade carries a cutting element to drill a formation.

3. The downhole tool of claim 1, wherein the blade carries a stabilizer pad.

4. The downhole tool of claim 1, wherein the elongated body has an elongated, radial slot disposed opposite an area of outer surface eccentricity and housing the blade.

5. The downhole tool of claim 1, wherein the blade is radially extended upon actuation by drilling fluid pressure present in an internal space within the elongated body.

6. The downhole tool of claim 1, wherein the blade radially extends from the elongated body upon actuation.

7. The downhole tool of claim 1, wherein the elongated body has an elongated, radial slot disposed opposite an area of outer surface eccentricity comprising a hump region where the blade is housed, and wherein the tool further comprises:

the shaft housed within the body and anchored at one end within the hump region;

and a stop limit member at the opposite end of the shaft for engagement with the collar.

8. The downhole tool of claim 1, further comprising: a hump region formed on the body between its ends;

an elongated, radial slot in the body opposite the hump region, to blade being housed within the slot; an internal space for pressurized fluid within the body; the shaft anchored at one end within the hump region and oriented to extend perpendicular to the longitudinal axis of the body;

a shear pin engaging the blade to retain it in position until actuation by pressurized fluid in the internal space; and a stop limit member at the opposite end of the shaft for engagement with the collar.

9. The downhole tool of claim 8, further comprising: a seal between the blade and an interior wall of the slot.

10. The downhole tool of claim 8, further comprising: a lubrication reservoir formed in the blade.

11. The downhole tool of claim 2, wherein the blade has an outer end surface configuration of a predetermined thickness and radius of curvature to define contact points at the edges of the outer end surface.

12. The downhole tool of claim 11, further comprising a non-cutting element disposed at each of the contact points at the edges of the outer end surface of the blade and a cutting element between the edges of the outer end surface.

13. The downhole tool of claim 1, wherein the blade has an outer end surface configuration of a predetermined thickness and radius of curvature based upon the drill out diameter, the blade outer end surface defining contact points at the edges having non-cutting elements.

14. A method of drilling a well borehole, comprising the steps of; affixing a drill bit to drill string; providing a downhole tool in the drill string up-hole from the drill bit, the downhole tool comprising a blade housed within an eccentrically-shaped body and having a plurality of cutter elements, the blade being actuated under fluid pressure for deployment of the cutters to a drill out diameter larger than a pass-through diameter; and aligning an area of eccentricity on the eccentrically shaped body of the downhole tool with reamer blades of the bi-center bit.

15. The method of claim 14, further comprising the step of: providing a second downhole tool in the drill string up-hole from the first downhole tool, the second downhole tool comprising a blade housed within an eccentrically-shaped body and having a plurality of cutter elements, the blade being actuated under fluid pressure for deployment of the cutters to a drill out diameter larger than a pass-through diameter.

16. The method of claim 15, wherein the first downhole tool deploys its cutters to a first drill out diameter and the second downhole tool deploys its cutters to a second drill out diameter.

17. The method of claim 16, wherein the first drill out diameter is smaller than the second drill out diameter.

18. The method of claim 15, wherein an area of eccentricity on the first downhole tool is evenly spaced radially from an area of eccentricity on the second downhole tool.

19. The method of claim 14, wherein the downhole tool is stacked with the drill bit.

20. A downhole drilling tool comprising: an elongated body having first and second ends along a longitudinal axis of the body for attachment to a drill string, the elongated body having an internal space to be supplied with a drilling fluid under pressure, an area of eccentricity to one side of the longitudinal axis, and a slot to an opposite side of the longitudinal axis; and a reamer blade having a plurality of cutter elements, the reamer blade being housed within the slot of the elongated body and actuated by the pressure of the drilling fluid to radially extend from the slot for deployment to a drill out diameter larger than a pass-through diameter wherein the reamer blade has a beveled edge surface configuration adapted to engage a casing surface to cause retraction of the reamer blade into the slot.

21. The downhole tool of claim 20, further comprising non-cutting elements disposed at contact points on an edge of the reamer blade and adjacent the cutters.

22. A method of drilling a well borehole, comprising the steps of: affixing a drill bit to a drill string;

providing a downhole tool in the drill string up-hole from the drill bit, the downhole tool comprising a blade housed within an eccentrically-shaped body and having a stabilizer pad, the blade being actuated under fluid pressure for deployment of the stabilizer to a drill out diameter; and, aligning an area of eccentricity on the eccentrically-shaped body of the downhole tool the reamer blades of the bi-center bit.

23. The method of claim 22, wherein the drill bit is a bi-center bit having reamer blades.

24. A downhole drilling system for attachment to a drill string comprising:

(a) a first tool comprising: an elongated body having an eccentric outer surface configuration between its ends; a blade housed within the elongated body and actuated under fluid pressure for deployment to a drill out diameter larger than a pass-through diameter; and (b) a second tool stacked with the first tool comprising: an elongated body having an eccentric outer surface configuration between its ends; a blade bowed within the elongated body an actuated under fluid pressure for deployment to a drill out diameter larger than a pass-through diameter;

wherein the body of the first tool has a hump area defining the eccentric outer surface configuration and the blade is housed within the hump area; and wherein the body of the second tool has hump area defining the eccentric outer surface configuration and the blade is housed within the body opposite the hump area, whereby the hump areas of the first and second tools are aligned the blades of first and second tools extend in diametrically opposite directions upon actuation for deployment.

* * * * *